US009066583B2

(12) United States Patent
Kayser

(10) Patent No.: US 9,066,583 B2
(45) Date of Patent: Jun. 30, 2015

(54) PACKAGED TOOTHBRUSH AND TOOTHBRUSH CONTAINER AND METHODS OF MAKING SAME

(75) Inventor: Steven L. Kayser, Ferndale, WA (US)

(73) Assignee: Loops LLC, Ferndale, WA (US)

( * ) Notice: Subject to any disclaimer, the term of this patent is extended or adjusted under 35 U.S.C. 154(b) by 2119 days.

(21) Appl. No.: 11/653,153

(22) Filed: Jan. 12, 2007

(65) Prior Publication Data

US 2007/0119736 A1 May 31, 2007

Related U.S. Application Data

(63) Continuation-in-part of application No. 29/275,027, filed on Dec. 8, 2006, now Pat. No. Des. 601,805, which is a continuation-in-part of application No. 11/563,671, filed on Nov. 27, 2006, now Pat. No. 8,448,285, which is a continuation-in-part of application No. 10/920,822, filed on Aug. 18, 2004, now Pat. No. 7,334,286.

(51) Int. Cl.

| | |
|---|---|
| ***B65D 83/10*** | (2006.01) |
| ***A46B 15/00*** | (2006.01) |
| ***A46B 5/00*** | (2006.01) |
| ***A46B 5/02*** | (2006.01) |

(52) U.S. Cl.

CPC ..... *A46B 15/0081* (2013.01); *A46B 5/0075* (2013.01); *A46B 5/0079* (2013.01); *A46B 5/02* (2013.01); *A46B 15/0055* (2013.01); *A46B 2200/1066* (2013.01)

(58) Field of Classification Search

CPC ..... A45D 44/18; A46B 17/04

USPC ..... 206/209, 209.1, 361, 362.2; 132/308–311

See application file for complete search history.

(56) References Cited

U.S. PATENT DOCUMENTS

| | | | | | |
|---|---|---|---|---|---|
| 2,719,626 | A | * | 10/1955 | Lermer | 206/362.2 |
| 2,775,250 | A | * | 12/1956 | Oxenrider | 132/308 |
| 2,815,057 | A | * | 12/1957 | Tupper | 220/796 |
| D243,156 | S | * | 1/1977 | Fentules | D9/426 |
| 4,234,087 | A | * | 11/1980 | Pandak | 206/362.2 |
| 4,615,635 | A | * | 10/1986 | Kim | 401/270 |
| 4,847,939 | A | * | 7/1989 | Derencsenyi et al. | 15/246 |
| 5,076,428 | A | * | 12/1991 | Shaw | 206/362.2 |
| D337,207 | S | * | 7/1993 | Tiramani et al. | D4/199 |
| D338,123 | S | * | 8/1993 | Crawford | D4/199 |
| 5,291,878 | A | | 3/1994 | Lombardo et al. | |
| 5,375,711 | A | * | 12/1994 | Bree et al. | 206/362.2 |
| 5,622,195 | A | * | 4/1997 | Lee | 132/289 |
| 5,630,244 | A | * | 5/1997 | Chang | 15/167.1 |
| 5,630,505 | A | * | 5/1997 | Garcia | 206/362.1 |
| 5,653,343 | A | * | 8/1997 | Imai | 206/581 |

(Continued)

FOREIGN PATENT DOCUMENTS

| | | |
|---|---|---|
| EP | 336641 | 10/1989 |
| WO | 0129128 | 4/2001 |

*Primary Examiner* — Anthony Stashick
*Assistant Examiner* — Blaine Neway
(74) *Attorney, Agent, or Firm* — Timothy W. Fitzwilliam

(57) ABSTRACT

The disclosed embodiments relate to a packaged toothbrush and toothbrush container and methods of making them, wherein the toothbrush container includes a flexible pliable resilient lid securable to a flexible pliable resilient body of the toothbrush container. The packaged toothbrush included a flexible resilient pliable toothbrush adapted to be disposed within toothbrush container and can be manipulated into a flexed position.

25 Claims, 1 Drawing Sheet

(56) References Cited

U.S. PATENT DOCUMENTS

| | | | | |
|---|---|---|---|---|
| 5,692,603 | A * | 12/1997 | Stotesbury | 206/209.1 |
| 5,778,478 | A | 7/1998 | Coleman | |
| 5,996,790 | A * | 12/1999 | Yamada et al. | 206/316.1 |
| 6,295,686 | B1 * | 10/2001 | Phillips | 15/167.1 |
| 6,298,516 | B1 | 10/2001 | Beals et al. | |
| D457,718 | S * | 5/2002 | McDonald | D3/205 |
| 6,526,991 | B2 * | 3/2003 | Bodwalk | 132/309 |
| 6,546,583 | B1 | 4/2003 | Rohrig | |
| 6,668,416 | B1 | 12/2003 | Georgi et al. | |
| 6,895,976 | B2 * | 5/2005 | Hetzler et al. | 132/308 |
| 2002/0038772 | A1 * | 4/2002 | Blaustein et al. | 206/362.2 |
| 2003/0208870 | A1 * | 11/2003 | Jimenez | 15/167.1 |
| 2005/0011789 | A1 * | 1/2005 | Tsaur | 206/361 |

* cited by examiner

PACKAGED TOOTHBRUSH AND TOOTHBRUSH CONTAINER AND METHODS OF MAKING SAME

RELATED APPLICATIONS

The present application is a continuation in part application of U.S. patent application Ser. No. 29/275,027, filed Dec. 8, 2006 now U.S. Pat. No. Des. 601,805, entitled "Toothbrushes," which is a continuation in part application of U.S. patent application Ser. No. 11/563,671 , filed Nov. 27, 2006 now U.S. Pat. No. 8,448,285, entitled "Toothbrush and Methods of Making and Using Same," which is a continuation in part patent application Ser. No. 10/920,822, filed Aug. 18, 2004 now U.S. Pat. No. 7,334,286, entitled "Toothbrush and Methods of Making and Using Same," which applications are each hereby incorporated by reference in their entirety.

FIELD OF THE INVENTION

The present invention is related in general to a packaged toothbrush and a toothbrush container and methods of making them. The invention more particularly relates to such a packaged toothbrush and a toothbrush container, which may be safely used by prison or inmates as well as other facilities or circumstances where safety may be important.

BACKGROUND ART

There is no admission that the background art described in this section legally constitutes prior art.

Prison and other detention systems monitor devices permitted to be used by inmates to prevent the use of an otherwise safe device as a weapon. For example, conventional toothbrushes and toothbrush containers are not permitted to be used by many prison systems because they may be fashioned into a pointed shaft or rod or otherwise used as a shank for a sharp object such as a razor blade, which could be used to endanger other inmates as well as security personnel.

Prison inmates often share their space with other inmates, and therefore they need a way to hygienically store their toothbrush, to keep it clean and free from contamination.

Thus, there is a need in the art for a packaged toothbrush and a toothbrush container which may be safely used by prison or other detention inmates.

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
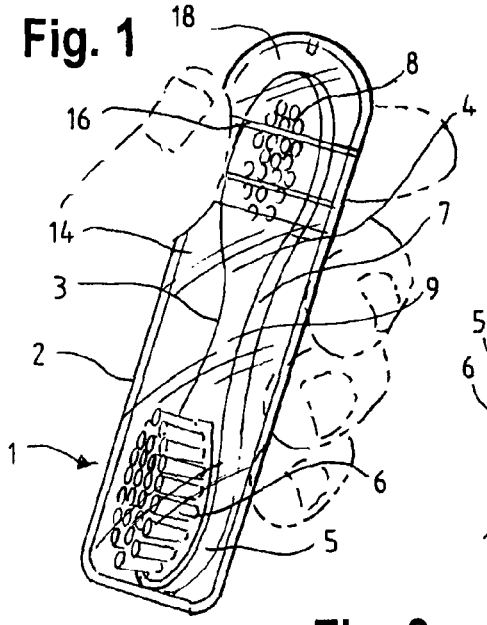
FIG. 1 is a pictorial view of a packaged toothbrush comprising a toothbrush and a toothbrush container; which is constructed according to an embodiment of the invention.

Certain embodiments of the present invention will now be described more fully hereinafter with reference to the accompanying drawings, in which some, but not all, embodiments of the invention are shown. Indeed, these embodiments of the invention may be in many different forms and thus the invention should not be construed as limited to the embodiments set forth herein; rather, these embodiments are provided as illustrative examples only so that this disclosure will satisfy applicable legal requirements. Like numbers refer to like elements throughout.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiment of the invention.

A toothbrush container confining a flexible toothbrush, includes an elongated flexible pliable resilient hollow tubular body composed of a pliable resilient material having an access opening at one end. The body is sized to receive snugly the toothbrush. A flexible pliable resilient lid closes the opening for securing the toothbrush within the body, the lid being composed of a pliable material. An annular flange on the lid engages the body frictionally to secure removably the lid to the body.

The toothbrush container further includes at least one drain opening, which may be in the form of a hole or slit for draining liquid from the interior of the container and for permitting air to enter the container interior. The at least one opening may be disposed in the body, the lid, or both.

The disclosed toothbrush container is comprised of a pliable material, such as an extrudable elastomer, which is durable and has a durometer hardness of between about 20 and about 55 on the Shore A Scale. The pliable material may be one or more of the following: polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS, SEBS and SIBS-triblock copolymers, and acrylic rubber. The pliable material may permit repeated flexing or bending of the toothbrush container without substantial damage to the toothbrush container. The container may be sufficiently resilient to restore to its unstressed shape and configuration after being distorted under manual stress being applied to it. The pliable material generates soft fragments with dull edges upon cracking, breaking or tearing of the toothbrush container.

The disclosed toothbrush container may be, for certain applications, safe for use by persons housed in a penal or other institution such as a psychiatric institution, to help prevent or at least reduce greatly the injury to the person using the toothbrush container or to other persons housed or working in the penal or psychiatric institutions or other facility. The toothbrush container may be clear and substantially transparent, allowing for easy identification of items contained within the toothbrush container without opening the toothbrush container or removal of the items contained within the toothbrush container.

A method for making a toothbrush container is also disclosed, wherein the method may include blow molding a flexible, resilient, pliable material into a hollow tubular body and a cup shaped lid. The pliable material enables repeated flexing or bending of the toothbrush container without substantial damage to the toothbrush container. The pliable material may, under circumstances, generate soft fragments only with dull edges upon cracking, breaking or tearing of the toothbrush container.

A packaged toothbrush is also disclosed and includes the aforementioned disclosed toothbrush container and a flexible pliable resilient toothbrush enclosed therein. The flexible toothbrush may include an elongated body having a head end portion containing bristle brushes and having a handle portion. The body may be composed of flexible material, and the handle portion has an enlarged rear end portion which is wider than the head end portion and has a narrowed intermediate portion therebetween.

The disclosed packaged toothbrush may also be, for certain applications, safe for use by persons housed in a penal institution, a psychiatric institution or other facility to prevent injury to the person using the toothbrush container or to other persons housed or working in the penal or psychiatric institutions or other such facility.

The disclosed packaged toothbrush may be a flexible toothbrush as disclosed in one or more of the foregoing patent applications.

The disclosed method for making the flexible toothbrush for the packaged toothbrush may include molding a flexible material, such as an extrudable elastomer, into a body having a brush head portion and a handle portion, and is described more fully in U.S. patent application Ser. No. 10/920,822, filed Aug. 18, 2004 entitled "Toothbrush and Methods of Making and Using Same," as well as one or more of the other aforementioned applications.

Figure 2:
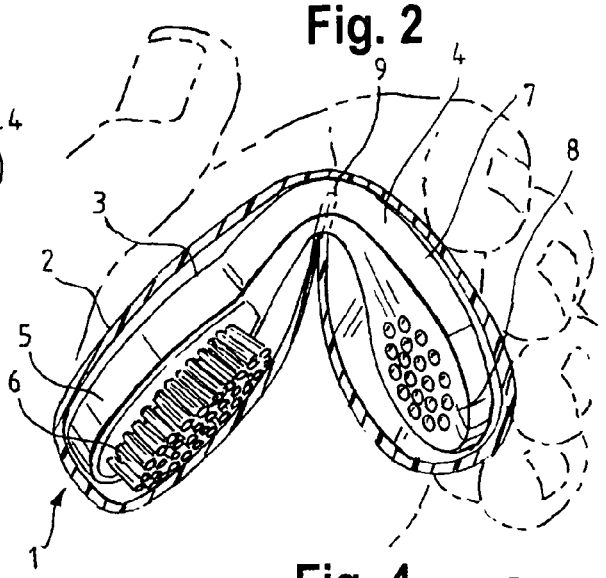
FIG. 2 is a pictorial view of the packaged toothbrush of FIG. 1, illustrating the packaged toothbrush including its contained toothbrush being manually flexed.

Referring now to the drawings, and more particularly to FIG. 1 thereof, there is shown a packaged toothbrush 1, comprising a toothbrush container 2 and a toothbrush 3 disposed within the toothbrush container 2. The toothbrush 3 generally comprises an elongated body 4 having a head end portion 5 containing bristle brushes 6 and a short handle portion 7. The body 4 may be composed of flexible pliable resilient material. The handle portion 7 may have an enlarged generally curvilinear flat rear end portion 8 which may be substantially wider than the head end portion 5 and may have a narrowed intermediate portion 9 therebetween to facilitate manually bending it into a V or C shape as shown in FIG. 2.

The toothbrush container 2 may generally comprise of an elongated flexible pliable resilient hollow tubular body 14, which is composed of a pliable suitable material. The body 14 has an opening or mouth 16 at one end, the opposite end being closed. The body 14 is sized to receive snugly the toothbrush 3. The toothbrush container 2 may further include a reclosable lid 18, which may be secured releasably over the opening 16 of the body 14 for retaining releasably the toothbrush 12 within the body 14. The lid 18 may also be composed of a flexible pliable resilient material.

Figure 3:
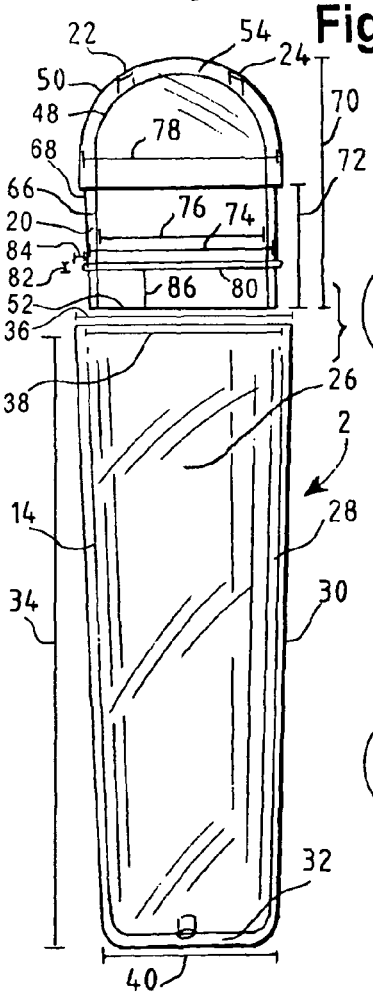
FIG. 3 is an enlarged exploded elevational view of the toothbrush container of FIG. 1, with the lid portion shown separate from the body portion.

Referring now to FIG. 3, the lid 18 of the toothbrush container 2 may include an annular depending flange 20 for engaging frictionally and for being secured removably within the opening 16 of the body 14. The toothbrush container 2 may include at least one opening such as the openings 22 and 24 in the form of holes for draining liquid from the container interior 26 and for permitting air to enter the interior of the container 26. The openings 22 and 24 in the toothbrush container 2 may be disposed in the body 14, the lid 18, or in both.

The tubular body 14 of the toothbrush container 2 is cylindrically shaped, and has a smooth inner wall surface 28 and a smooth outer wall 30 surface. The tubular body 14 may include a closed bottom end 32.

In the embodiment shown in FIG. 3, the body may have a length 34 of about 100 mm. The open top end 16 of the tubular body 14 may have an outer wall diameter 36 of about 30 mm and an inner wall diameter 38 of about 27 mm. The closed bottom end 32 of the tubular body 14 may have an outer wall diameter 40 of about 26 mm.

Figure 5:
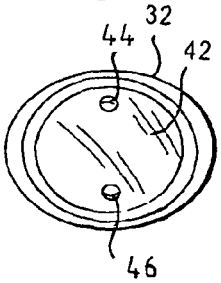
FIG. 5 is a bottom end view of the body portion of the toothbrush container of FIG. 3.
Figure 4:
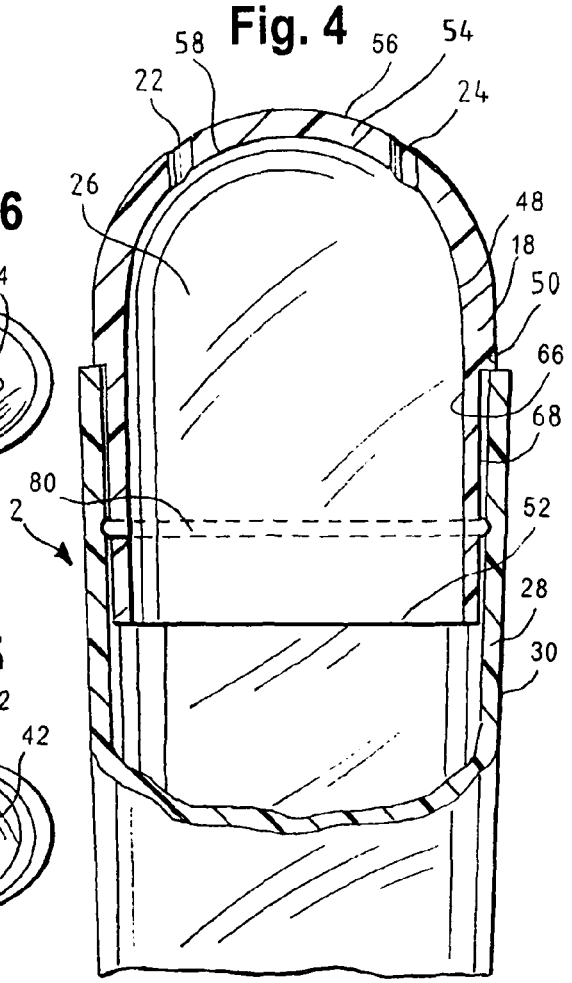
FIG. 4 is a top end view of the lid portion of the toothbrush container of FIG. 3.

In the embodiment shown in FIG. 5, the closed bottom end 32 of the tubular body portion 14 of the toothbrush container 2 may include a smooth flat surface 42 in which at least one opening such as openings 44 and 46 22 may be located for draining any accumulated fluid such as a liquid from the interior of the container and for permitting air to enter the container interior. These openings 44 and 46 may be in the form of holes.

Figure 6:
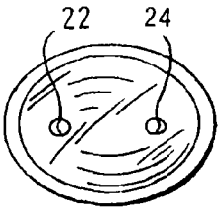
FIG. 6 is a greatly enlarged fragmentary sectional view of the toothbrush container of FIG. 4, illustrating the lid portion secured within the body portion.

Referring now to FIG. 6, the lid 18 of the toothbrush container 2 may be generally cup or bullet shaped, and is hollow. The lid 18 has a smooth inner wall surface 48 and an outer wall surface 50. The lid 18 of the toothbrush container 2 may include an open bottom end 52 and a smoothly rounded dome-shaped closed top end 54. The closed top end 54 has a smooth rounded outer surface 56 with a concave inner wall surface 58. The openings such as the openings 22 and 24 may be disposed in the closed top end 54 for draining liquid from the interior of the container 26 and for permitting air to enter the container interior 26. These one or more openings 22 and 24 may be in the form of holes.

As shown in FIGS. 3 and 6, the annular flange 20 at the open bottom end 52 of the lid 18 may have an inner wall 66 and an outer wall 68. The annular flange 20 may have a diameter that is reduced in size to fit snugly within the open mouth of the body 14.

In the embodiment shown in FIG. 3, the lid 18 has a length 70 of about 40 mm and the annular flange 20 has a length 72 of about 20 mm. The annular flange 20 has an outer wall diameter 74 of about 26 mm and an inner wall diameter 76 of about 23 mm. The closed top end 54 of the lid 18 has an outer wall diameter 78 of about 30 mm.

Referring to FIGS. 3 and 6, the annular flange 20 of the lid 18 has an annular rib or projection 80 for engaging the smooth inner surface of the wall 28 of the tubular body 14 in a frictional manner, allowing the lid 18 to be snugly engaged with the tubular body 14 and enabling the lid 18 to be retained in this engaged position with the tubular body 14, while also allowing for easy manual removal of the lid 18 from the tubular body 14 to insert or remove the toothbrush 3.

In the embodiment shown in FIG. 3, the annular rib 80 has a width 82 of about 1 mm and a depth 84 of about 1 mm, and the annular rib 80 is located a length 86 of about 7 mm from the open bottom end 52 of the lid 18.

In the embodiment shown in FIGS. 1 and 2, the toothbrush 3 contained within the toothbrush container 2 is flexible and pliable and composed of suitable resilient material. When contained within the toothbrush container 2, the toothbrush 3 as well as the toothbrush container 2 may be subjected to repeated flexing or bending with little or no damage to either the toothbrush 3 or the toothbrush container 2. In this regard, as shown in FIG. 2, the entire packaged toothbrush 1 may fit within the hand of the user and bend into a V or C shape. Both the container 2 and the toothbrush 3 may be manually bent about their midsections into a stressed configuration. Thereafter, the packaged toothbrush can be released and it snaps back to its unstressed condition as shown in FIG. 1.

The toothbrush 3 contained within the toothbrush container 2 may be selected from one or more of the toothbrushes disclosed in the foregoing patent application.

Although the invention has been described with reference to the above examples, it will be understood that many modifications and variations are contemplated within the true spirit and scope of the embodiments of the invention as disclosed herein. Many modifications and other embodiments of the invention set forth herein will come to mind to one skilled in the art to which the invention pertains having the benefit of the teachings presented in the foregoing descriptions and the associated drawings. When the term "about" or the term "approximately" or other such terms are used herein, it is to be understood that a plus or minus 20 percent variation may be employed. Therefore, it is to be understood that the invention shall not be limited to the specific embodiments disclosed and that modifications and other embodiments are intended and contemplated to be included within the scope of the appended claims. Although specific terms are employed herein, they are used in a generic and descriptive sense only and not for purposes of limitation.

What is claimed is:

1. A toothbrush container for confining a toothbrush, comprising:

an elongated flexible pliable resilient hollow tubular body composed of a pliable material and having an access opening at one end thereof , the body sized to receive snugly the toothbrush;

a flexible pliable resilient lid for closing the access opening to secure the toothbrush within the body, the lid being composed of pliable material; and an annular flange on the lid for engaging the body portion frictionally to secure removably the lid to the body.

2. A toothbrush container according to claim 1, further including at least one drain opening.

3. A toothbrush container according to claim 2, wherein the said at least one drain opening is hole for draining liquid form the interior of the container and for permitting air to enter the container interior.

4. A toothbrush container according to claim 3, wherein the tubular body has a length of about 100 mm.

5. A toothbrush container according to claim 3, wherein the tubular body further includes a closed bottom end.

6. A toothbrush container according to claim 4, wherein the open top end of the tubular body has an outer wall diameter of about 30 mm and an inner wall diameter of about 27 mm, and wherein the closed bottom end of the tubular body has an outer wall diameter of about 26 mm.

7. A toothbrush container according to claim 5, wherein the closed bottom end of the tubular body further includes a smooth flat surface upon which said at least one opening is located for draining liquid form the interior of the container and for permitting air to enter the container interior.

8. A toothbrush container according to claim 3, wherein the lid portion comprises a cup shaped lid.

9. A toothbrush container according to claim 4, wherein the lid has a length of about 40 mm.

10. A toothbrush container according to claim 8, wherein the lid further includes an open bottom end and a closed top end.

11. A toothbrush container according to claim 10, wherein the closed top end of the lid has a smoothly rounded surface with a concave inner wall surface and a convex outer wall surface in which said at least one opening is located for draining liquid from the interior of the container and for permitting air to enter the container interior.

12. A toothbrush container according to claim 10, wherein the annular flange of the lid is disposed at the open bottom end.

13. A toothbrush container according to claim 1, wherein the outer wall of the annular flange of the lid portion has a diameter that is reduced in size to fit within the access opening of the body.

14. A toothbrush container according to claim 13, wherein the annular flange has a length of about 20 mm.

15. A toothbrush container according to claim 14, wherein the annular flange has an outer wall diameter of about 26 mm and an inner wall diameter of about 23 mm.

16. A toothbrush container according to claim 14, wherein the closed top end of the lid has an outer wall diameter of about 30 mm.

17. A toothbrush container according to claim 11, wherein the outer wall of the annular flange of the lid has at least one annular rib for engaging the smooth inner wall of the tubular body in a frictional manner, allowing the lid to be snugly engaged within the tubular body and enabling the lid to be retained in such engaged position with the tubular body, while also permitting for easy removal of the lid manually from the tubular body.

18. A toothbrush container according to claim 17, wherein the annular rib has a width of about 1 mm and a depth of about 1 mm, and wherein the annular rib is located at a length of about 7 mm from the open bottom end of the lid.

19. A toothbrush container according to claim 1, wherein the toothbrush contained within the toothbrush container is a flexible toothbrush, and wherein the toothbrush container and the flexible toothbrush contained within the toothbrush container may be subjected to repeated flexing or bending.

20. A toothbrush container according to claim 1, wherein the pliable material of the toothbrush container is an extrudable elastomer.

21. A toothbrush container according to claim 1, wherein the pliable material is selected from the group consisting of polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate polycarbonate, polyetherimide, polyethylene (LDPE, HDPE, LLDPE, and blends) polypropylene and copolymers, polysulfone, polysulfides, vition, PUNA nitrile, carboxylated nitrile, polysulfides, alpha olefin elastomers, conjugated diene elastomers hydrogenated diene elastomers, ethylene carboxylate, ethylene-proplyene-diene elastomers, functionalized ethylene-vinyl acetate, SB-diblock copolymers, SBS, SEBS and SIBS-triblock copolymers, and acrylic rubber.

22. A toothbrush container according to claim 1, wherein the pliable material is durable and has a durometer hardness of between about 20 and about 55.

23. A toothbrush container according to claim 1, wherein the pliable material allows for repeated flexing or bending of the toothbrush about its midpoint.

24. A toothbrush container according to claim 1, wherein the toothbrush container substantially transparent for allowing for identification of items contained within the toothbrush container.

25. A packaged toothbrush comprising:

a toothbrush container including:

an elongated flexible pliable resilient hollow tubular body being composed of a pliable material and having an access opening at one end thereof;

a lid disposed at the access opening for closing over the hollow interior of the body, said lid being composed of pliable flexible resilient material; and an annular flange on the lid for engaging the body frictionally to secure removably the lid to the body; and a flexible toothbrush being disposed within the container and including:

an elongated body having a head end portion containing bristle brushes and a short stubby handle portion;

the elongated body being composed of flexible material; and wherein the handle portion has an enlarged curvilinear flat rear end portion being substantially wider than the head end portion and having a narrowed intermediate portion and having a narrowed intermediate portion therebetween to facilitate bending the toothbrush thereabout, and wherein the handle portion is entirely composed of flexible material thereby permitting the package toothbrush to be flexed into substantially a "C" shape.

* * * * *